US006732998B2

(12) United States Patent
Sugawara et al.

(10) Patent No.: US 6,732,998 B2
(45) Date of Patent: May 11, 2004

(54) METHOD OF FORMING LAMINATED CORE AND ELECTROMAGNETIC TYPE VALVE DRIVING DEVICE

(75) Inventors: Masafumi Sugawara, Tokyo (JP); Masatoshi Ueda, Tokyo (JP); Kazuhiko Fukushima, Tokyo (JP); Akihiko Imagi, Tokyo (JP); Masao Morita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 162 days.

(21) Appl. No.: 10/084,202

(22) Filed: Feb. 28, 2002

(65) Prior Publication Data

US 2003/0042455 A1 Mar. 6, 2003

(30) Foreign Application Priority Data

Aug. 31, 2001 (JP) ..... 2001-264346

(51) Int. Cl.[7] ..... F16K 31/06
(52) U.S. Cl. ..... 251/129.07; 251/129.15
(58) Field of Search ..... 251/129.01–129.22

(56) References Cited

U.S. PATENT DOCUMENTS

| | | | | |
|---|---|---|---|---|
| 4,631,809 A | * | 12/1986 | Yokoi | |
| 5,554,901 A | | 9/1996 | Wendel et al. | |
| 5,632,259 A | * | 5/1997 | Konda et al. | 123/634 |
| 5,897,096 A | * | 4/1999 | Nakano | 251/129.15 |
| 6,047,672 A | * | 4/2000 | Hanai et al. | 251/129.01 |
| 6,066,998 A | * | 5/2000 | Trumper et al. | 335/229 |

FOREIGN PATENT DOCUMENTS

| | | |
|---|---|---|
| DE | 965 344 C1 | 6/1957 |
| DE | 12 95 690 B | 5/1969 |
| DE | 26 58 456 A1 | 6/1978 |
| DE | 30 27 067 C2 | 2/1982 |
| DE | 32 02 704 A1 | 8/1982 |
| DE | 31 05 652 A1 | 9/1982 |
| DE | 36 15 529 A1 | 11/1987 |
| DE | 196 11 547 A1 | 9/1997 |
| DE | 197 35 375 C1 | 7/1998 |
| DE | 198 25 732 A1 | 2/1999 |
| DE | 100 53 464 A1 | 5/2001 |
| DE | 199 55 067 A1 | 5/2001 |
| DE | 199 61 608 A1 | 7/2001 |
| DE | 199 61 609 A1 | 7/2001 |
| DE | 100 01 872 C1 | 8/2001 |
| EP | 0 921 536 A1 | 6/1999 |
| FR | 2 620 852 A1 | 3/1989 |
| FR | 2 784 497 A1 | 4/2000 |
| JP | 11-260634 | 9/1999 |
| WO | WO 00 29723 A1 | 5/2000 |

* cited by examiner

*Primary Examiner*—Paul J. Hirsch
(74) *Attorney, Agent, or Firm*—Sughrue Mion, PLLC

(57) ABSTRACT

A center core laminated part and a side core laminated part are formed separately from each other. The center core laminated part is integrated with the side core laminated part by engaging depressed engaging portions with projected engaging portions, wherein the depressed engaging portions and the projected engaging portions are formed relatively on the corresponding opposite surfaces, to form a laminated core part for forming a magnetic path.

10 Claims, 8 Drawing Sheets

METHOD OF FORMING LAMINATED CORE AND ELECTROMAGNETIC TYPE VALVE DRIVING DEVICE

BACKGROUND OF THE INVENTION

1. Field of the Invention

The present invention relates to a method of forming a laminated core for forming a magnetic path and an electromagnetic type valve driving device to which the laminated core for forming a magnetic path is applied.

2. Description of the Prior Art

A laminated core part used for an electromagnetic type valve driving device generates a magnetic field by an electric current to drive a movable iron core, thereby opening/closing a valve fixed to a valve shaft via a coupling shaft integrally formed with the movable iron core. In this case, since a considerably large force is necessary for driving the valve, the laminated core part needs to be strengthened strong and to be joined to the movable iron core with high accuracy. Otherwise, the laminated core part itself is attracted by an electromagnetic attractive force, which causes distortion or breakage. Thus, conventionally, the laminated core part is fixed by a projection formed at the shoulder portion thereof or by another member inserted into a through hole made in the laminated core part.

Since the laminated core part is formed in the manner described above, it can be easily fixed but has the following drawbacks: in the former method, fixing only the shoulder portion causes a strain at the center portion and utilizing the shoulder portion enlarges the size thereof in the lateral direction, which may be preferably avoided since the lateral direction is a direction where the valves are adjacent to each other; in the latter method, if the inserted member is not enough large in size, the laminated core, together with the inserted member, is distorted by the electromagnetic attractive force. Further, the latter method is thought to present a problem that a large through hole reduces power because the through hole is made in the laminated core itself. Still further, the latter method raises a problem that because a considerably large force is applied to the laminated core part, the laminated core part can not be divided and that another member provided with a winding is inserted into the laminated core part, which results in the inefficient use of the space of the winding.

SUMMARY OF THE INVENTION

The present invention has been made to solve the above drawbacks. The object of the present invention is to provide a method of forming a laminated core part by which the laminated core part can be assembled with enhanced ease and accuracy and be increased in mechanical strength, and an electromagnetic type valve driving device using the laminated core part as an iron core for forming a magnetic path.

According to a first aspect of the present invention, there is provided a method of forming a laminated core, comprising the steps of: forming a center core laminated part and a side core laminated part separately; and integrating the center core laminated part with the side core laminated part by engaging depressed engaging portions with projected engaging portions, wherein the depressed engaging portions and the projected engaging portions are formed relatively on the corresponding opposite surfaces in the shape of an inverted wedge, to form a laminated core part for forming a magnetic path.

Here, the forming step may include a step of forming a top base and a bottom base separately, and the integrating step may include a step of engaging depressed engaging portions with projected engaging portions which are formed relatively on the corresponding opposite surfaces in the shape of an inverted wedge.

Then, an inwardly bent portion may be formed at the end portion of the side core laminated part and a depressed engaging portion formed on the inwardly bent portion may be engaged with a projected engaging portion, which is formed relatively on the opposite surface of the center core laminated part, the top base or the bottom base opposite to the inwardly bent portion in the shape of an inverted wedge, to integrate the side core laminated part with the center core laminated part, the top base or the bottom base.

In addition, depressed engaging portions may be formed relatively on the corresponding opposite surfaces of the center core laminated part, the side core laminated part, the top base and the bottom base in the shape of an inverted wedge, and wherein separate engaging members, each of which has projected engaging portions formed on both surfaces thereof in the shape of an inverted wedge, may be engaged with the depressed engaging portions opposed thereto to integrate the center core laminated part, the side core laminated part, the top base and the bottom base into one piece.

According to a second aspect of the present invention, there is provided an electromagnetic type valve driving device comprising: an iron core for forming a magnetic path; a movable iron core forming a part of the iron core for forming a magnetic path; a coil for generating a magnetic flux when an electric current is passed therethrough; a movable iron core coupling shaft coupled with the movable iron core at the end portion thereof and driven by an electromagnetic force and a spring force; and a valve shaft made to abut on the end surface of the movable iron core coupling shaft by the spring force, characterized in that a center core laminated part and a side core laminated part, which are formed separately from each other, are integrated with each other by engaging depressed engaging portions with projected engaging portions, wherein the depressed engaging portions and the projected engaging portions are formed relatively on the corresponding opposite surfaces in the shape of an inverted wedge, to form the iron core for forming a magnetic path.

Here, the electromagnetic type valve driving device may further comprise: a top base and a bottom base, which are formed separately from each other, are integrated into one piece by engaging depressed engaging portions with projected engaging portions, wherein the depressed engaging portions and the projected engaging portions are formed relatively on the corresponding opposite surfaces in the shape of an inverted wedge.

DETAILED DESCRIPTION OF THE PREFERRED EMBODIMENTS

An embodiment of the present invention will be described below.

EMBODIMENT 1

Figure 1:
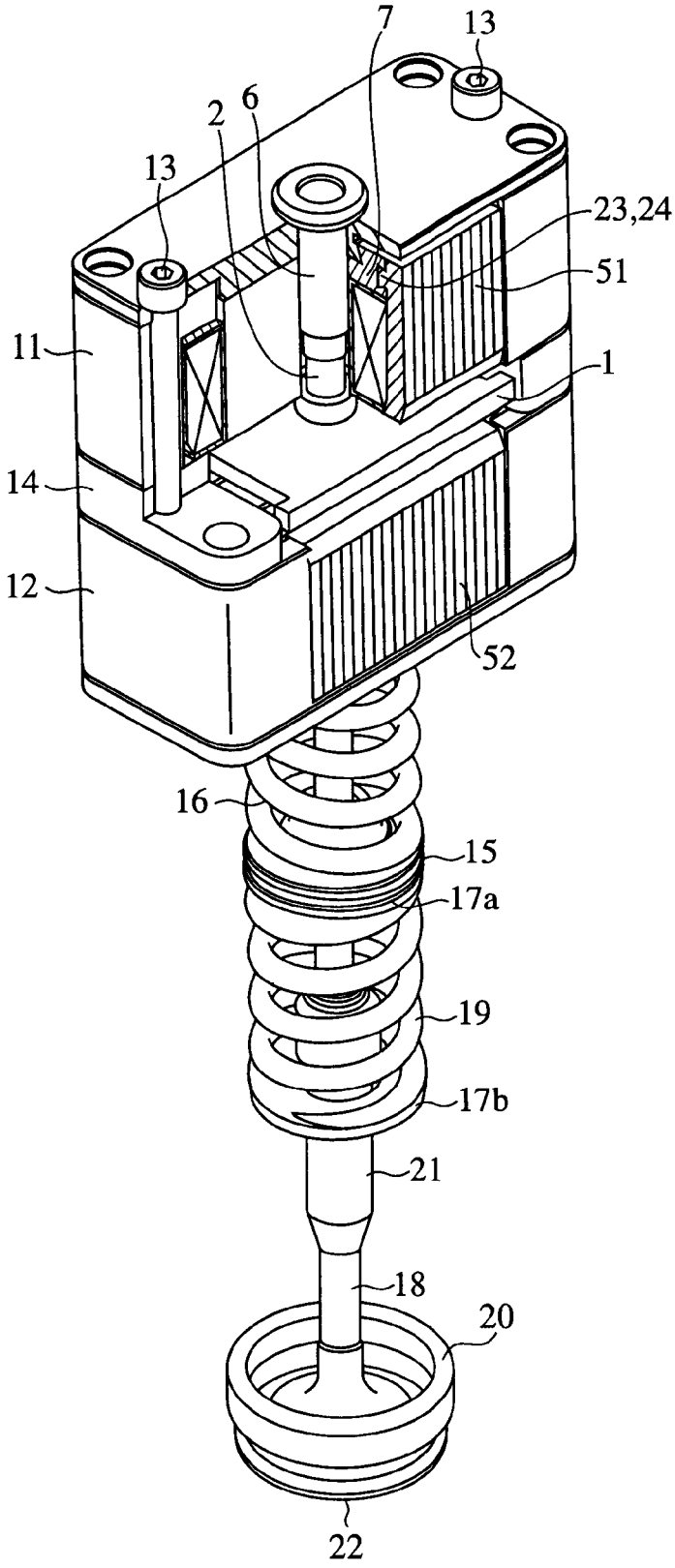
FIG. 1 is an external view with parts partially broken away, in perspective, of an electromagnetic type valve driving device in which a laminated core part formed by a method of forming a laminated core part in accordance with the present invention is applied as an iron core for forming a magnetic path.
Figure 2:
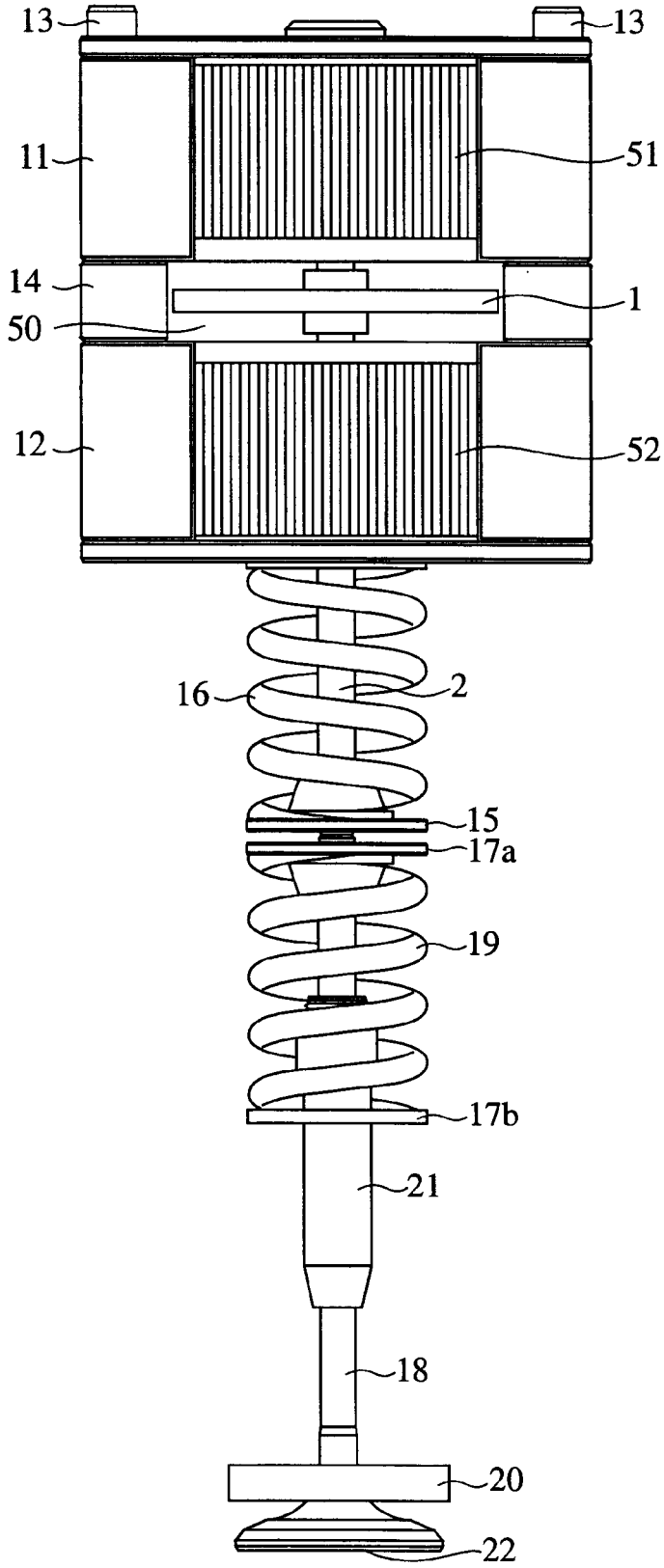
FIG. 2 is a front view in FIG. 1.
Figure 3:
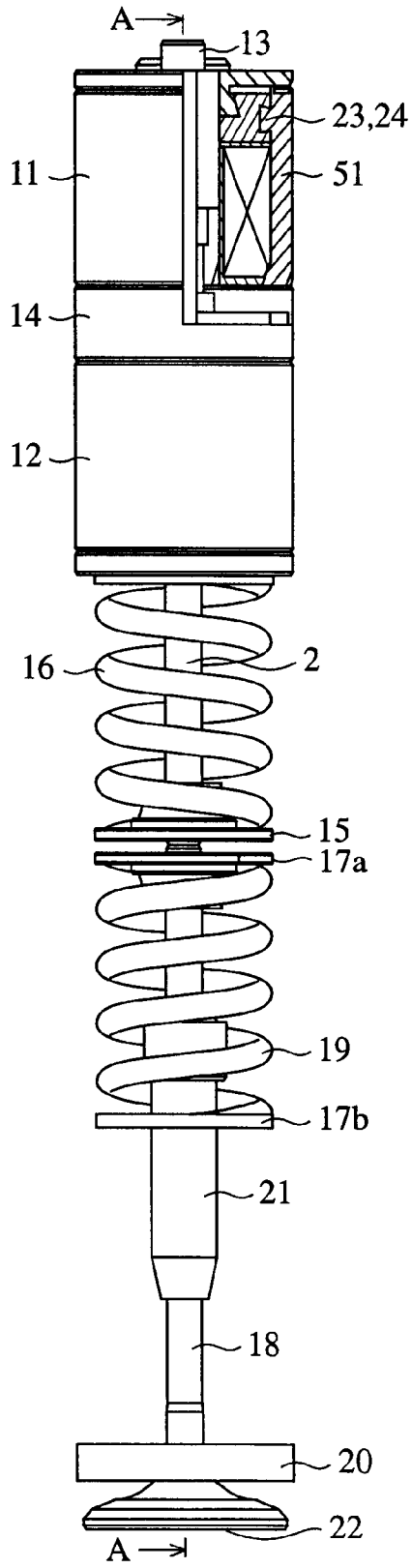
FIG. 3 is a side view in FIG. 1.
Figure 4:
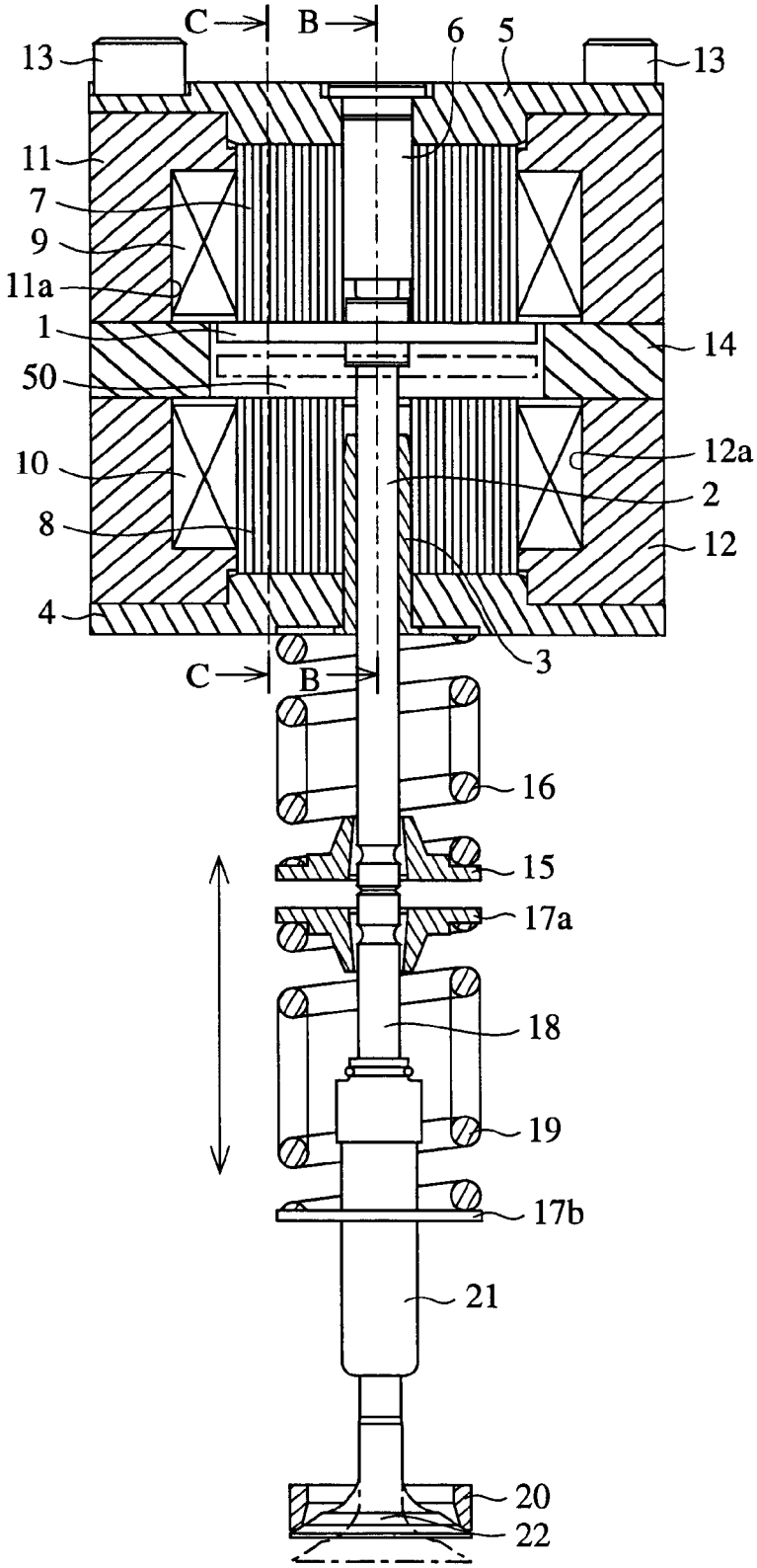
FIG. 4 is a longitudinal sectional view taken on a line A—A in FIG. 3.
Figure 5:
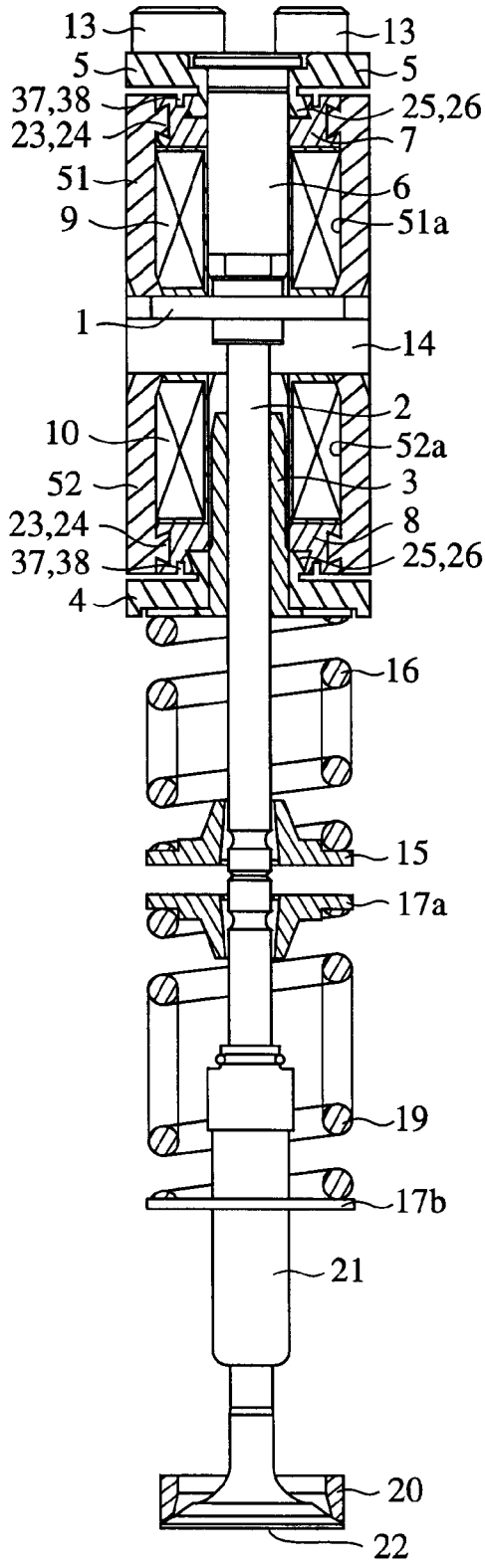
FIG. 5 is a longitudinal sectional view taken on a line B—B in FIG. 4.
Figure 6:
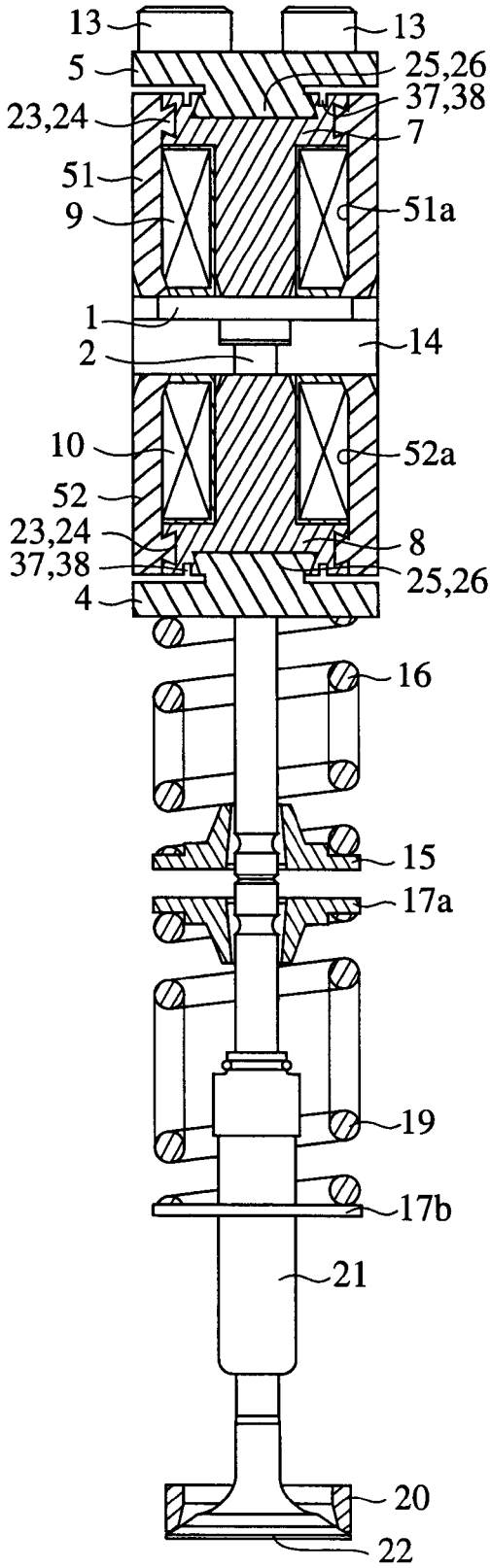
FIG. 6 is a longitudinal sectional view taken on a line C—C in FIG. 4.

FIG. 1 is an external view with parts partially broken away, in perspective, of an electromagnetic type valve driving device in which a laminated core part formed by a method of forming a laminated core part in accordance with the present invention is applied as an iron core for forming a magnetic path. FIG. 2 is a front view in FIG. 1. FIG. 3 is a side view in FIG. 1. FIG. 4 is a longitudinal sectional view taken on a line A—A in FIG. 3. FIG. 5 is a longitudinal sectional view taken on a line B—B in FIG. 4. FIG. 6 is a longitudinal sectional view taken on a line C—C in FIG. 4.

In FIGS. 1 to 6, a reference numeral 1 denotes a movable iron core coupled to a movable iron core coupling shaft 2; a reference numeral 3 denotes a bearing for supporting the movable iron core coupling shaft 2; a reference numeral 4 denotes a bottom base provided with the bearing 3; a reference numeral 5 denotes a top base provided with a displacement sensor 6 for measuring the travel position of the movable iron core coupling shaft 2; reference numerals 7, 8 denote upper and lower center cores provided with coils 9, 10; reference numerals 11, 12 denote upper and lower side plates having recessed portions 11*a*, 12*a* for receiving the coils 9, 10; a reference numeral 13 denotes bolts for integrally mounting and fixing the upper and lower cores 7, 8 and the upper and lower side plates 11, 12 between the bottom base 4 and the top base 5 with a gap keeping member 14 interposed between the upper and lower side plates 11, 12; a reference numeral 50 denotes a space formed between the upper and lower center cores 7, 8 to allow the movable iron core 1 to move; and reference numerals 51, 52 denote upper and lower side cores having recessed portions 51*a*, 52*a* for receiving the coils 9, 10.

Further, a reference numeral 15 denotes a spring support fixed to the bottom end portion of the movable iron core coupling shaft 2; a reference numeral 16 denotes the first coil spring mounted on the shaft between the bottom surface of the bottom base 4 and the spring support 15; reference numerals 17*a*, 17*b* denote spring supports fixed to the top end portion and the middle portion of a valve shaft 18 whose top end is made to abut on the bottom end of the movable iron core coupling shaft 2; a reference numeral 19 denotes the second coil spring mounted on the valve shaft 18 between the spring supports 17*a*, 17*b*; a reference numeral 20 denotes a valve seat; a reference numeral 21 denotes a bearing of the valve shaft 18 mounted on a cylinder head (not depicted); and a reference numeral 22 denotes a valve mounted on the bottom end of the valve shaft 18.

Next, the operation of the valve driving device will be described. When an electric current is not passed through the coils 9, 10, the movable iron core 1 is positioned at a given position in the space 50 by the balance of the spring force between the first coil spring 16 and the second coil spring 19.

In this state, when the electric current is passed through the coil 10 to open the valve, the movable iron core 1 is moved to the side of the center core 8 by the electromagnetic force generated by magnetic flux passing through the magnetic path produced by the movable iron core 1, the side core 52 and the center core 8 and the spring force of the first coil spring 16, thereby moving down the movable iron core connecting shaft 2 and the valve shaft 18 against the second coil spring 19 to open the valve 22. Here, the amount of opening of the valve 22 is determined by the amount of electric current passed through the coil 10.

Next, when the passage of electric current through the coil 10 is stopped and the electric current is passed through the coil 9 so as to close the valve 22, the movable iron core 1 is moved to the side of the center core 7 by the electromagnetic force generated by magnetic flux passing through the magnetic path produced by the movable iron core 1, the side core 51 and the center core 7 and the spring force of the second coil spring 19, thereby moving up the movable iron core coupling shaft 2 and the valve shaft 18 against the first coil spring 16 to close the valve 22.

According to the present invention, the center cores 7, 8 and the upper and lower side cores 51, 52 are formed of laminated cores, respectively by the method in which: the center cores 7, 8 and the side cores 51, 52 are separately formed; the coils 9, 10 are mounted on the center cores 7, 8, respectively: then, as shown in FIG. 5 and FIG. 6, the center core 7 is integrated with the side core 51 and the center core 8 is integrated with the side core 52, respectively, by engaging depressed engaging portions 23 with projected engaging portions 24, wherein the depressed engaging portions 23 and the projected engaging portions 24 are formed relatively on the opposite surfaces of the center cores 7, 8 and the side cores 51, 52 in the shape of an inverted wedge; and then the top base 5 and the bottom base 4 are combined with the integrated center cores 7, 8 by the use of depressed engaging portions 25 and projected engaging portions 26, which are formed relatively on the opposite surfaces of the center cores 7, 8 and the top and bottom bases 5, 4 in the shape of an inverted wedge, and portions 37, 38 for relieving the stresses produced when the projected engaging portions 26 are press-fitted into the depressed engaging portions 25.

Figure 7:
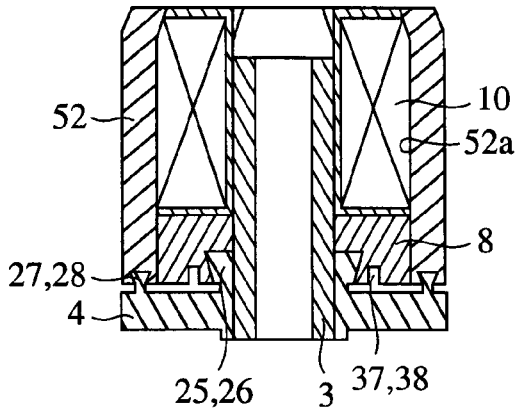
FIG. 7 is a longitudinal sectional view of a part to show a modification.

FIG. 7 is a modification in which only the bottom base 4, the center core 8, and the side core 52 are shown and are combined with each other by the use of depressed engaging portions 25 and projected engaging portions 26, which are formed relatively on the opposite surfaces of the center core 8 and the bottom base 4 in the shape of an inverted wedge, depressed engaging portions 27 and projected engaging portions 28, which are formed relatively on the opposite surfaces of the side core 52 and the bottom base 4 in the shape of an inverted wedge, and portions 37, 38 for relieving the stresses produced when the projected engaging portions 26 are press-fitted into the depressed engaging portions 25.

Figure 8:
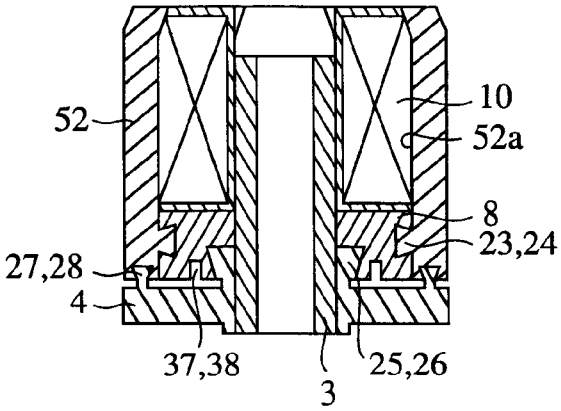
FIG. 8 is a longitudinal sectional view of a part to show a modification.

In the modification shown in FIG. 8, depressed engaging portions 23 and projected engaging portions 24, which are formed relatively on the opposite surfaces of the center core 8 and the side core 52 in the shape of an inverted wedge, are engaged with each other to integrate the center core 8 with the side core 52; and the bottom base 4, the center core 8 and the side core 52 are integrally combined with each other by the use of depressed engaging portions 25 and projected engaging portions 26, which are formed relatively on the opposite surfaces of the center core 8 and the bottom base 4 in the shape of an inverted wedge, depressed engaging portions 27 and projected engaging portions 28, which are formed relatively on the opposite surfaces of the side core 52 and the bottom base 4 in the shape of an inverted wedge, and portions 37, 38 for relieving the stresses produced when the projected engaging portions 26 are press-fitted into the depressed engaging portions 25.

Figure 9:
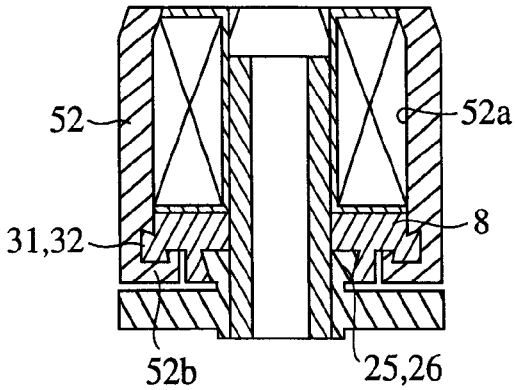
FIG. 9 is a longitudinal sectional view of a part to show a modification.

In the modification shown in FIG. 9, the bottom portion of the side core 52 is bent inwardly in the shape of a letter L to form an inwardly bent portion 52*b*. A projected engaging portion 32 formed at the bottom corner of the center core 8 is engaged with the depressed engaging portion 31 formed at the inwardly bent portion 52*b* to integrally combine the side core 52 with the center core 8.

Figure 10:
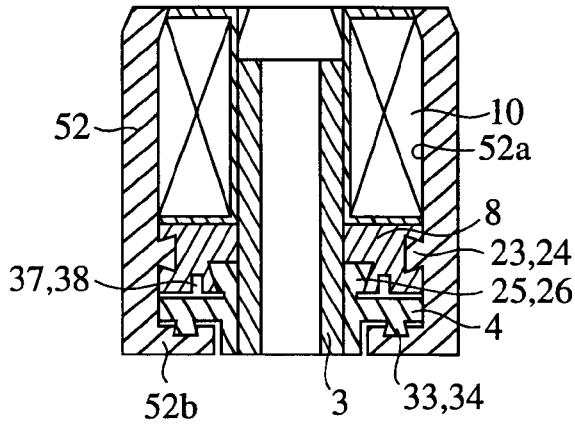
FIG. 10 is a longitudinal sectional view of a part to show a modification.

In the modification shown in FIG. 10, the bottom portion of the side core 52 is bent inwardly in the shape of a letter L to form an inwardly bent portion 52*b*. A projected engaging portion 34 formed at the bottom surface of the bottom base 4 is engaged with the depressed engaging portion 33 formed at the inwardly bent portion 52*b* to integrally combine the side core 52 with the bottom base 4, and the other engagements are the same as those in FIGS. 5, 6.

Figure 11:
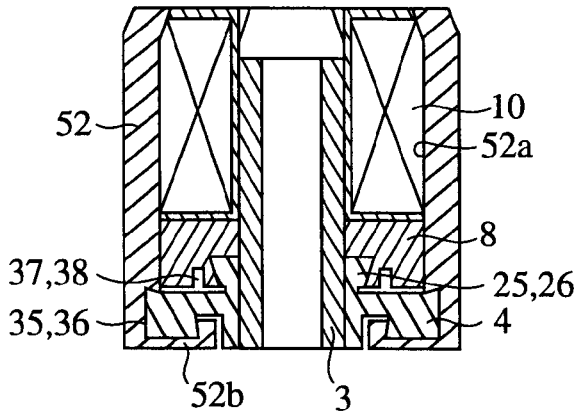
FIG. 11 is a longitudinal sectional view of a part to show a modification.

In the modification shown in FIG. 11, the bottom portion of the side core 52 is bent inwardly in the shape of a letter L to form an inwardly bent portion 52*b*. A projected engaging portion 36 formed at the bottom surface of the bottom base 4 is engaged with the depressed engaging portion 35 formed at the inwardly bent portion 52*b* to integrally combine the side core 52 with the bottom base 4, and the center core 8 is combined with the bottom base 4 in the same way shown in FIG. 7. Here, while only the side of the movable iron core 2*a* has been illustrated and described in the modifications in FIGS. 7 to 11, the outside iron core 2*b* is also formed in the same configuration and has the same effect.

Figure 12:
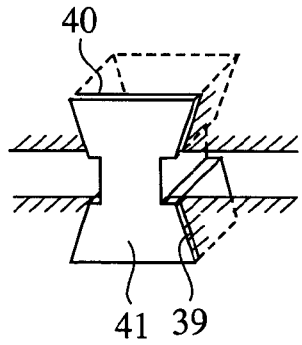
FIG. 12 is an enlarged perspective view of a portion where a center core laminated part is engaged with a side core laminated part.

While the depressed engaging portions and projected engaging portions are formed relatively on the opposite surfaces in the shape of an inverted wedge in the aforementioned embodiment 1 and the respective modifications, as shown in FIG. 12, it is also recommended that only depressed engaging portions 39, 40 be formed, in the shape of an inverted wedge, relatively on the respective opposite surfaces of the center core, the side core, and the top and bottom bases and that separate engaging members 41, each of which has projected engaging portions formed on both surfaces in the shape of an inverted wedge, be engaged with the respective depressed engaging portions 39, 40, opposed thereto, of the center core, the side core, and the top and bottom bases to integrate the center core, the side core, the top and bottom bases into one piece.

As described above, according to the present invention, the center core laminated part and the side core laminated part are separately formed and the depressed engaging portions and the projected engaging portions, which are formed relatively on the opposite surfaces thereof in the shape of an inverted wedge, are engaged with each other to integrate the center core laminated part with the side core laminated part to form the laminated core part for forming the magnetic path. Therefore, this can join the laminated core part most efficiently and makes an effect of improving efficiency in winding the coil around the core because, in the case of an integrated core, a coil can not be directly wound around the core and thus the efficient use of the space for winding in the core can not be achieved, whereas in the case of this laminated core part the coil can be wound directly around the core to achieve the efficient use of the space for winding in the core.

According to the present invention, the center core laminated part, the side core laminated part, the top base and the bottom base are separately formed and the engaging depressed engaging portions and the projected engaging portions, which are formed relatively on the opposite surfaces thereof in the shape of an inverted wedge, are engaged with each other to integrate the respective center core laminated part, the side core laminated part, the top base and the bottom base into one piece to form the laminated core part for forming the magnetic path. Therefore, the laminated cores are joined to the top and bottom bases as if the respective pieces of the laminated cores were directly jointed to the top and bottom bases, so the laminated core part of the movable iron core is not distorted or separated by the electromagnetic attractive force during the operation of the movable iron core. Further, joining the center core laminated part, the side core laminated part, and the top and bottom bases at the same time can make an effect of shortening the processes.

According to the present invention, the inwardly bent portions are formed at the end portions of the side core laminated part and the depressed engaging portions formed on the surfaces of the inwardly bent portions are engaged with the projected engaging portions, which are formed relatively on the opposite surfaces of the center core laminated part or the top base or the bottom base opposite to the inwardly bent portions in the shape of an inverted wedge, to integrate the side core laminated part with the center core laminated part, the top base or the bottom base to form the laminated core part for forming the magnetic path. Therefore, the inwardly bent portions receive the center core laminated part or the top surface of the top base and the bottom face of the bottom base, thereby making an effect of enhancing an integrating force against an external force to open the core such as vibration and the like.

According to the present invention, depressed engaging portions are formed relatively on the respective opposite surfaces of the center core laminated part, the side core laminated part and the top base and bottom base in the shape of an inverted wedge and separate engaging members, each of which has projected engaging portions formed on both surfaces in the shape of an inverted wedge, are engaged with the respective depressed engaging portions opposed thereto to integrate the center core, the side core, and the top and bottom bases into one piece, thereby forming the laminated core part for forming the magnetic path. Therefore, it is essential that only the depressed portions formed in the shape of an inverted wedge are formed in the center core laminated part, the side core laminated part and the top base and bottom base. This can make an effect of making these parts easily.

According to the present invention, the center core laminated part and the side core laminated part, which are formed separately from each other, are engaged with each other by the use of the depressed engaging portions and the projected engaging portions, which are formed relatively on the opposite surfaces of the respective parts in the shape of an inverted wedge, to form the iron core for forming the magnetic path of the electromagnetic type valve driving device. Therefore, this has an effect of making the electromagnetic type valve driving device in a simple configuration with high accuracy.

According to the present invention, the center core laminated part and the side core laminated part and the top and bottom bases, which are formed separately from each other, are engaged with each other by the use of the depressed engaging portions and the projected engaging portions, which are formed relatively on the opposite surfaces of the respective parts and bases in the shape of an inverted wedge, to form the iron core for forming the magnetic path of the electromagnetic type valve driving device. Therefore, this has an effect of making the electromagnetic type valve driving device in a simple configuration with high accuracy.

What is claimed is:

1. A method of forming a laminated core, comprising the steps of:

forming a center core laminated part and a side core laminated part separately; and integrating the center core laminated part with the side core laminated part by engaging depressed engaging portions with projected engaging portions, wherein the depressed engaging portions and the projected engaging portions are formed relatively on the corresponding opposite surfaces in the shape of an inverted wedge, to form a laminated core part for forming a magnetic path.

2. A method of forming a laminated core according to claim 1, wherein the forming step further includes a step of forming a top base and a bottom base separately, and the integrating step further includes a step of engaging said top and/or bottom base to said laminated core part using depressed engaging portions with projected engaging portions which are formed relatively on the corresponding opposite surfaces in the shape of an inverted wedge.

3. A method of forming a laminated core according to claim 1, wherein an inwardly bent portion is formed at the end portion of the side core laminated part and a depressed engaging portion formed on the inwardly bent portion is engaged with a projected engaging portion, which is formed relatively on the opposite surface of the center core laminated part, a top base or a bottom base opposite to the inwardly bent portion in the shape of an inverted wedge, to integrate the side core laminated part with the center core laminated part, the top base or the bottom base.

4. A method of forming a laminated core according to claim 1, wherein depressed engaging portions are formed relatively on the corresponding opposite surfaces of the center core laminated part, the side core laminated part, a top base and a bottom base in the shape of an inverted wedge, and wherein separate engaging members, each of which has projected engaging portions formed on both surfaces thereof in the shape of an inverted wedge, are engaged with the depressed engaging portions opposed thereto to integrate the center core laminated part, the side core laminated part, the top base and the bottom base into one piece.

5. The method of claim 1, further wherein said forming a center core laminated part and a side core laminated part includes forming top and bottom center core laminated parts and top and bottom side core laminated parts;

said integrating the center core laminated part with the side core laminated part by engaging depressed engaging portions with projection engaging portions includes integrating top and bottom center core laminated parts with top and bottom side core laminated parts, respectively, by engaging depressed engaging portions with projection engaging portions; wherein the top center core laminated part integrated with the top side core laminated part forms a first magnetic path; and the bottom center core laminated part integrated with the bottom side core laminated part forms a second magnetic path.

6. The method of claim 5, further wherein electrical engagement of one of the first or second magnetic paths causes magnetic flux to engage a valve in an open position and electrical engagement of the other one of the first or second magnetic paths causes magnetic flux to engage the valve in a closed position.

7. An electromagnetic type valve driving device comprising:

an iron core for forming a magnetic path;

a movable iron core forming a part of the iron core for forming a magnetic path;

a coil for generating a magnetic flux when an electric current is passed therethrough;

a movable iron core coupling shaft coupled with the movable iron core at the end portion thereof and driven by an electromagnetic force and a spring force; and a valve shaft made to abut on the end surface of the movable iron core coupling shaft by the spring force, characterized in that a center core laminated part and a side core laminated part, which are formed separately from each other, are integrated with each other by engaging depressed engaging portions with projected engaging portions, wherein the depressed engaging portions and the projected engaging portions are formed relatively on the corresponding opposite surfaces in the shape of an inverted wedge, to form the iron core for forming a magnetic path.

8. An electromagnetic type valve driving device according to claim 7, further comprising: a top base and a bottom base, which are formed separately from each other, are integrated into one piece with said iron core by engaging depressed engaging portions with projected engaging portions, wherein the depressed engaging portions and the projected engaging portions are formed relatively on the corresponding opposite surfaces in the shape of an inverted wedge.

9. The device of claim 7, further wherein said center core laminated part and said side core laminated part further comprises top and bottom center core laminated parts and top and bottom side core laminated parts;

the center core laminated part being integrated with the side core laminated part by engaging depressed engaging portions with projection engaging portions further includes integrating the top and bottom center core laminated parts with the top and bottom side core laminated parts, respectively, by engaging depressed engaging portions with projection engaging portions; wherein the top center core laminated part integrated with the top side core laminated part forms a first magnetic path; and the bottom center core laminated part integrated with the bottom side core laminated part forms a second magnetic path.

10. The device of claim 9, further wherein electrical engagement of one of the first or second magnetic paths causes magnetic flux to engage a valve in an open position and electrical engagement of the other one of the first or second magnetic paths causes magnetic flux to engage the valve in a closed position.

* * * * *